US009080118B2

(12) United States Patent
Schaberg et al.

(10) Patent No.: US 9,080,118 B2
(45) Date of Patent: Jul. 14, 2015

(54) DIESEL ENGINE INJECTOR FOULING IMPROVEMENTS WITH A HIGHLY PARAFFINIC DISTILLATE FUEL

(75) Inventors: Paul Werner Schaberg, Noord-hoek (ZA); Adrian James Velaers, Cape Town (ZA)

(73) Assignee: Sasol Technology (Pty) Ltd, Johannesburg (ZA)

( * ) Notice: Subject to any disclaimer, the term of this patent is extended or adjusted under 35 U.S.C. 154(b) by 0 days.

(21) Appl. No.: 13/696,026

(22) PCT Filed: May 5, 2011

(86) PCT No.: PCT/ZA2011/000031

§ 371 (c)(1),
(2), (4) Date: Jan. 15, 2013

(87) PCT Pub. No.: WO2011/140572

PCT Pub. Date: Nov. 10, 2011

(65) Prior Publication Data

US 2013/0125849 A1 May 23, 2013

(30) Foreign Application Priority Data

May 6, 2010 (ZA) ..... 2010/03201

(51) Int. Cl.

| | |
|---|---|
| ***F02B 43/00*** | (2006.01) |
| ***C10L 1/04*** | (2006.01) |
| ***C10L 1/08*** | (2006.01) |
| ***C10L 10/04*** | (2006.01) |
| ***C10L 1/19*** | (2006.01) |
| ***F02B 77/00*** | (2006.01) |

(52) U.S. Cl.
CPC ... *C10L 1/04* (2013.01); *C10L 1/08* (2013.01); *C10L 1/19* (2013.01); *C10L 10/04* (2013.01); *F02B 77/00* (2013.01)

(58) Field of Classification Search
CPC ..... C10L 1/04; C10L 1/14; C10L 10/12; C10L 2200/0492; C10G 2300/1022; F02B 3/06
USPC ..... 44/385, 300, 302, 411; 585/13, 14; 123/1 A
See application file for complete search history.

(56) References Cited

U.S. PATENT DOCUMENTS

| | | | |
|---|---|---|---|
| 7,374,657 | B2 | 5/2008 | Miller et al. |
| 7,666,294 | B2 | 2/2010 | Bauldreay et al. |
| 7,785,378 | B2 | 8/2010 | O'Rear |

(Continued)

FOREIGN PATENT DOCUMENTS

| | | | |
|---|---|---|---|
| WO | WO 03/091364 | A2 | 11/2003 |
| WO | WO 2005/021688 | A1 | 3/2005 |

(Continued)

*Primary Examiner* — Lindsay Low
*Assistant Examiner* — Long T Tran
(74) *Attorney, Agent, or Firm* — Knobbe Martens Olson & Bear, LLP

(57) ABSTRACT

The invention provides the use of a highly paraffinic distillate fuel in a diesel fuel composition for reducing the formation of injector nozzle deposits when combusted in a diesel engine having a high pressure fuel injection system, wherein the distillate fuel has an aromatics content less than 0.1 wt %, a sulfur content less than 10 ppm and a paraffinic content of at least 70 wt %, such that the diesel fuel composition has a relative fouling behavior of 70% or less and a density of more than 0.815 g. $cm^{-3}$ (at 15° C.).

23 Claims, 3 Drawing Sheets

(56) References Cited

U.S. PATENT DOCUMENTS

| | | | | |
|---|---|---|---|---|
| 7,846,323 | B2 | 12/2010 | Abhari et al. | |
| 7,897,824 | B2 | 3/2011 | Aulich et al. | |
| 7,972,392 | B2 * | 7/2011 | Eichhorn et al. | 44/300 |
| 8,076,522 | B2 | 12/2011 | Clark et al. | |
| 2002/0148754 | A1 * | 10/2002 | Gong et al. | 208/3 |
| 2005/0241216 | A1 * | 11/2005 | Clark et al. | 44/436 |
| 2007/0187292 | A1 | 8/2007 | Miller et al. | |
| 2007/0245620 | A1 * | 10/2007 | Malfer et al. | 44/329 |
| 2007/0265479 | A1 | 11/2007 | Landschof | |
| 2008/0244966 | A1 * | 10/2008 | Ansell et al. | 44/436 |
| 2010/0210737 | A1 | 8/2010 | Knottenbelt et al. | |
| 2010/0251603 | A1 * | 10/2010 | Davies et al. | 44/347 |
| 2011/0302828 | A1 * | 12/2011 | Fang et al. | 44/352 |

FOREIGN PATENT DOCUMENTS

| | | | |
|---|---|---|---|
| WO | WO 2005/021689 | A1 | 3/2005 |
| WO | WO 2008/012320 | A1 | 1/2008 |
| WO | WO 2008/104556 | A1 | 9/2008 |

* cited by examiner

DIESEL ENGINE INJECTOR FOULING IMPROVEMENTS WITH A HIGHLY PARAFFINIC DISTILLATE FUEL

CROSS-REFERENCE TO RELATED APPLICATIONS

This application is the national phase under 35 U.S.C. §371 of PCT International Application No. PCT/ZA2011/000031 which has an International Filing Date of May 5, 2011, which designates the United States of America, and which claims priority to South African Application No. 2010/03201 filed May 6, 2010, the disclosures of which are hereby expressly incorporated by reference in their entirety and are hereby expressly made a portion of this application.

FIELD OF THE INVENTION

The present invention relates generally to fuel compositions suitable for diesel engines with high pressure fuel injection systems; and more specifically to the use of a highly paraffinic distillate component in these compositions.

BACKGROUND OF THE INVENTION

In recent years, consumer demand and legislation requirements have promoted diesel engine technology advances resulting in improvements in energy efficiency and performance; and reductions in emission levels. These advances have largely been consequent of combustion process improvements achieved through finely divided atomisation of the fuel prior to combustion. This atomisation is typically achieved through the use of high pressure fuel injection systems and highly sophisticated electronic injectors—usually with an increase in the number; and a reduction in the size of the injector holes over those previously employed.

Critically, however, in these new injector systems, the negative impact of injector fouling or coking becomes far more significant. Fouling occurs where deposits occur in the internal passages or surfaces of the injector or could even form in other parts of the fuel delivery system. These deposits increase with degradation of the fuel and typically take the form of carbonaceous coke-like residues or sticky gum-like residues. This blocking or fouling results in less efficient fuel delivery and poor mixing with air prior to combustion. It is further exacerbated in injectors that have very small holes—where the threshold size for a deposit to have a substantial impact on performance is much reduced. Furthermore, within the injector body, there can be very small clearances between moving parts; where the impact of deposit formation can cause injectors to stick, particularly in the open position. As a result of these effects, injector fouling is known to lead to multiple problems such as power loss, increased emission levels and reduced fuel economy.

As previously discussed, high pressure fuel injection systems are also core to the recent performance improvements associated with this type of engine. In common rail systems, for example, the fuel is stored at high pressure in the central accumulator rail prior to being delivered to the injectors. Any unused heated fuel is then returned to the fuel tank, where it will then be introduced back into the accumulator rail on demand. Fuel being returned to the fuel tank via this route has been measured to have a temperature in excess of 100° C.

At the injector nozzle, the fuel pressure is commonly in excess of 1000 bar; and may be in excess of 2000 bar. Furthermore, as the fuel is circulated through the injector body itself, it is heated further due to heat conducted through the injector body from the combustion chamber. The temperature of the fuel at the tip of the injector can be as high as 250-350° C.

The high pressures inside these fuel delivery systems can also lead to a further source of stress on the fuel. Cavitation bubbles can form in the fuel because of the very low static pressure that occurs in high speed nozzle flow near a sharp inlet corner. The sharper the corner and the higher the velocity, the more likely cavitation is to occur. The formation of cavitation bubbles in common rail diesel injectors is well-documented. Typically, this has focused on the potential for mechanical damage or impact on injector performance; however, the implosion of cavitation bubbles must also have an impact on the stability of the fuel due to the extraordinarily high pressures and temperatures generated during this event.

Hence the diesel fuel in a common rail diesel engine is stressed:

at pressures of over 1000 bar; and at temperatures of up to 100° C. prior to the injection event and can be recirculated back within the fuel system thus increasing the time for which the fuel is exposed to these conditions. It can further experience cavitation during passage through the injector nozzle, which can potentially initiate instabilities in the fuel.

Diesel fuels become more unstable the more they are heated, particularly if they are heated under pressure. Thus diesel engines having high pressure fuel injection systems will typically exhibit increased fuel degradation and hence increased injector fouling over that observed in older technology engines.

Whilst injector fouling as a result of these factors may occur with any type of diesel fuel, some fuels can be particularly prone to this problem. For example, fuels containing biodiesel have been found to exhibit increased injector fouling. Diesel fuels containing metallic species may also experience increased deposit formation. Metallic species may be deliberately added to a fuel in additive compositions or may be present as contaminant species. Transition metals in particular cause increased deposits, especially copper and zinc species.

Modern diesel engines which incorporate a high pressure fuel injection system and typically also more sophisticated injector nozzle designs are therefore both more sensitive to injector fouling problems than those utilising older diesel technology; and more likely to experience significant injector fouling in the first place.

Typically these issues are addressed through the use of specialised detergency additives in the fuel composition. For example, PCT patent application WO2009/040586 discloses the use of at least 120 ppm of a nitrogen-containing detergency additive in a diesel fuel in order to improve the performance of a high pressure fuel system in a diesel engine by reducing injector fouling. However, the use of additives has a cost implication for fuel formulation and may also have concomitant detrimental effects on other aspects of fuel performance or behaviour.

PCT patent application WO2003/091364 discloses the use of Fischer-Tropsch derived distillate or gas oil fuel in a diesel blend in order to reduce engine fouling due to combustion-related deposits. This application discloses a fouling-related behaviour benefit for incorporating FT-derived distillate in the fuel with a focus on combustion-related fuel effects. Engine fouling (even specifically injector fouling) in indirectly injected engines is typically observed to be related to the combustion properties of the fuel. An analysis of the experimental data provided in this application indicates that in order to reduce the relative fouling behaviour of the fuel blend to 50% (i.e. midway between the fouling behaviours of the crude-derived and FT-derived blend components) an amount of FT-derived diesel significantly in excess of 60% by volume (ca. 70 volume %) is required. Such a blend is expected to have a density significantly less than 0.790 g.cm$^{-3}$, rendering it less useful as a commercial fuel (where typical commercial specifications require minimum densities of 0.80 g.cm$^{-3}$ (at 15° C.) or even 0.81 g.cm$^{-3}$ (at 15° C.)).

The inventors have determined, however, that in the case of high pressure directly injected diesel engines, moderate amounts of a highly paraffinic distillate fuel can surprisingly be used to provide significantly improved performance in terms of reducing injector fouling, whilst still providing a blend that is commercially useful by virtue of its higher density.

SUMMARY OF THE INVENTION

According to a first aspect of the invention, there is provided the use of a highly paraffinic distillate fuel in a diesel fuel composition for reducing the formation of injector nozzle deposits when combusted in a diesel engine having a high pressure fuel injection system, wherein the distillate fuel has an aromatics content less than 0.1 wt %, a sulphur content less than 10 ppm and a paraffinic content of at least 70 wt %, such that the diesel fuel composition has a relative fouling behaviour of 70% or less and a density of more than 0.815 g.cm$^{-3}$ (at 15° C.).

The highly paraffinic distillate fuel may be derived from a Fischer Tropsch process or may be hydrogenated renewable oil (HRO) or a combination of the two.

According to a second aspect of the invention, there is provided the use of a highly paraffinic distillate fuel in a diesel fuel composition in a diesel engine with a high pressure fuel injection system, wherein the distillate fuel has an aromatics content less than 0.1 wt %, a sulphur content less than 10 ppm and a paraffinic content of at least 70 wt % and is used for the purpose of reducing the formation of injector nozzle deposits such that the diesel fuel composition has a relative fouling behaviour of 60% or less and a density of more than 0.80 g.cm$^{-3}$ (at 15° C.).

According to a third aspect of the invention, there is provided the use of a highly paraffinic distillate fuel in a diesel fuel composition in a diesel engine with a high pressure fuel injection system, wherein the distillate fuel has an aromatics content less than 0.1 wt %, a sulphur content less than 10 ppm and a paraffinic content of at least 70 wt % and is used for the purpose of reducing the formation of injector nozzle deposits such that the diesel fuel composition has a relative fouling behaviour of 50% or less and a density of more than 0.79 g.cm$^{-3}$ (at 15° C.).

The highly paraffinic distillate fuel may have a cetane number greater than 70.

The diesel fuel composition may further comprise a petroleum-derived distillate fuel, a bio-derived fuel or a combination of the two.

The diesel fuel composition may have a minimum relative fouling behaviour of 30%.

The diesel engine may be a common rail diesel engine.

The fuel injection system may have one or more injector nozzles.

The one or more injector nozzles may have one or more holes each having a maximum equivalent diameter of 200 μm.

The one or more holes may each have a maximum equivalent diameter of 150 μm.

DETAILED DESCRIPTION OF THE INVENTION

Figure 1:
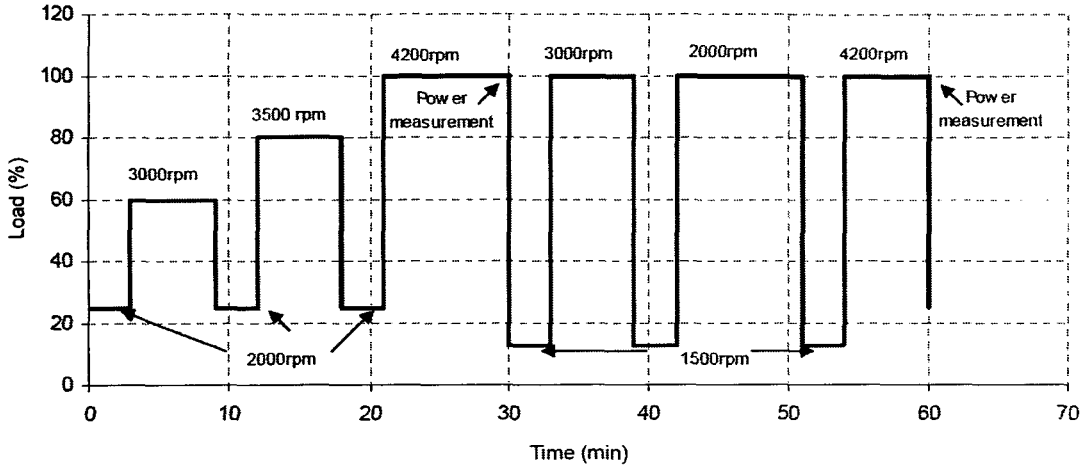
FIG. 1 is a graph depicting load (%) versus running time (hours) for the common rail diesel injector nozzle fouling test cycle from Example 1.

The diesel fuel composition used in the present invention will comprise at least two middle distillate components derived from different sources. Such distillate fuels typically boil within the range of from 110° C. to 500° C., e.g. 150° C. to 400° C.

Suitable Blend Components

The diesel fuel composition will comprise a blend of:

a highly paraffinic distillate fuel and at least one of:

- a petroleum-derived atmospheric distillate or vacuum distillate, cracked gas oil, or a blend in any proportion of straight run and refinery streams such as thermally and/or catalytically cracked and hydro-cracked distillates;
- a renewable fuel such as, but not limited to, a biofuel composition or biodiesel composition. The renewable fuel blendstock may comprise a first generation biodiesel. First generation biodiesel typically contains esters of, for example, vegetable oils, animal fats and used cooking fats that are obtained by reaction with an alcohol, usually a mono-alcohol, in the presence of a catalyst.

The highly paraffinic distillate fuel may be:

- a Fischer-Tropsch process derived fuel such as those described as GTL (gas-to-liquid) fuels, CTL (coal-to-liquid) fuels, OTL (oil sands-to-liquid) and BTL (biomass to liquid) and/or
- a renewable hydrogenated vegetable oil (HVO) suitable for use as a distillate fuel.

The highly paraffinic distillate fuel is characterised by having:

a paraffinic hydrocarbon content of at least 70 weight % an aromatic content of less than 0.1 weight % an sulphur content of less than 10 ppm

It may further have a cetane number greater than 70.

The FT process is used industrially to convert synthesis gas, derived from coal, natural gas, biomass or heavy oil streams, into hydrocarbons ranging from methane to species with molecular masses above 1400.

While the main products are linear paraffinic materials, other species such as branched paraffins, olefins and oxygenated components form part of the product slate. The exact product slate depends on reactor configuration, operating conditions and the catalyst that is employed, as is evident from e. g. Catal. Rev.—Sci. Eng., 23 (1 & 2), 265-278 (1981).

Preferred reactors for the production of heavier hydrocarbons are slurry bed or tubular fixed bed reactors, while operating conditions are preferably in the range of 160 C-280 C, in some cases 210260 C, and 18-50 Bar, in some cases 20-30 bar.

Preferred active metals in the catalyst comprise iron, ruthenium or cobalt. While each catalyst will give its own unique product slate, in all cases the product slate contains some waxy, highly paraffinic material which needs to be further upgraded into usable products. The FT products can be converted into a range of final products, such as middle distillates, gasoline, solvents, lube oil bases, etc. Such conversion, which usually consists of a range of processes such as hydrocracking, hydrotreatment and distillation, can be termed a FT work-up process.

The FT work-up process of this invention uses a feed stream consisting of C5 and higher hydrocarbons derived from a FT process. This feed is separated into at least two individual fractions, a heavier and at least one lighter fraction. The heavier fraction, also referred to as wax, contains a considerable amount of hydrocarbon material, which boils higher than the normal diesel range. If we consider a typical diesel boiling range of 160-370 C, it means that all material heavier than 370 C needs to be converted into lighter materials by means of a catalytic process often referred to as hydroprocessing, for example, hydrocracking.

Catalysts for this step are of the bifunctional type; i. e. they contain sites active for cracking and for hydrogenation. Catalytic metals active for hydrogenation include group VIII noble metals, such as platinum or palladium, or a sulphided Group VIII base metals, e. g. nickel, cobalt, which may or may not include a sulphided Group VI metal, e. g. molybdenum. The support for the metals can be any refractory oxide, such as silica, alumina, titania, zirconia, vanadia and other Group III, IV, VA and VI oxides, alone or in combination with other refractory oxides. Alternatively, the support can partly or totally consist of zeolite.

Process conditions for hydrocracking can be varied over a wide range and are usually laboriously chosen after extensive experimentation to optimize the yield of middle distillates.

Process Conditions for Hydrocracking:

| CONDITION | BROAD RANGE | PREFERRED RANGE |
|---|---|---|
| Temperature, ° C. | 150-450 | 340-400 |
| Pressure, barg | 10-200 | 30-80 |
| Hydrogen Flow Rate, $m^3_n/m^3$ feed | 100-2000 | 800-1600 |
| Conversion of >370° C. material, mass % | 30-80 | 50-70 |

Hydrogenated renewable oil (HRO) refers to the production of a renewable distillate fuel (or green or renewable diesel) through the chemical refining of any suitable vegetable- or animal-derived oil. Chemically, it entails catalytic hydrogenation of the oil, where the triglyceride portion is transformed into the corresponding alkane. (The glycerol chain of the triglyceride will also be hydrogenated to the corresponding alkane.) The process removes oxygenates from the oil; and the product is a clear and colourless paraffin that is effectively chemically identical to GTL diesel.

The diesel fuel composition may contain blends of any or all of the above diesel fuel components.

The diesel fuel composition of the present invention may further include one or more additives such as those commonly found in diesel fuels. These include, for example, antioxidants, dispersants, detergents, wax anti-settling agents, cold flow improvers, cetane improvers, dehazers, stabilisers, demulsifiers, antifoams, corrosion inhibitors, lubricity improvers, dyes, markers, combustion improvers, metal deactivators, odour masks, drag reducers and conductivity improvers. In particular, the composition of the present invention may further comprise one or more additives known to improve the performance of diesel engines having high pressure fuel systems.

The present invention finds utility in engines for heavy duty vehicles and passenger vehicles which have a high pressure fuel injection system. It has specific application to high pressure fuel injected engines wherein the injector nozzle has one or more holes of a diameter less than 200 μm; or more specifically less than 150 μm. (This in contrast to old technology indirectly injected engines where the comparable pintle type hole diameter is at least approximately 750 μm in size.)

Measurement of Injector Fouling

Historically, injector nozzle fouling in older technology diesel engines was not measured in situ during the engine test. For example, the industry standard CEC F-23-01 Peugeot XUD-9 injector fouling test for indirectly injected engines determines the extent of injector nozzle blockage through an air flow test carried out once the nozzles are removed from the engine.

Currently for high pressure fuel injection engines such as a common rail diesel engine, performance deterioration as a result of injector fouling may be determined in a number of ways, for example:

- through measurement of the power output in a controlled engine test—where power loss is then ascribed to injector fouling;
- through direct measurement of fuel flow through the injector in a controlled engine test—where flow loss is then ascribed to injector fouling Typically, the engine power output parameter is more easily measured, whilst the equipment required for fuel flow measurement is not always available, or of insufficient accuracy. The mechanism in the former case is that as the injector holes become smaller due to deposits, so the fuel flow decreases and consequently the power output of the engine also decreases. Generally, however, the power measurements show some scatter due to other variables that can cause slight changes in the engine power when measuring at the level of accuracy required. Hence, it has been found by the inventors that fuel flow rate is a more reliable parameter for measurement of injector fouling, with less scatter.

Accurate and reliable fuel flow rate measurements require sophisticated equipment and careful application, such as was applied for these tests. Fuel flow depends on rail pressure, injection duration (pulse length), fuel temperature and the size and shape of the injector nozzle holes. If rail pressure, injection duration and fuel temperature are held constant throughout the running time of the test, then any reduction in fuel flow can be directly attributed to the narrowing of the injector nozzle holes due to deposit formation.

A modified variation of the standard industry common rail diesel engine test (known as the CEC F-98-08 DW10 test) for evaluating injector nozzle fouling was used by the inventors to evaluate the relative performances of the fuel blends to be investigated. The modifications to the method made centre around the use of a modified test cycle and a different engine type. Additionally fuel flow rate was measured directly (rather than inferred from engine power output) and no zinc salt was used in order to simulate a high fouling fuel. The modified test conditions are described in detail in the examples.

Quantification of Relative Injector Fouling Behaviour for a Fuel Blend

The relative fouling behaviour is a means of quantitatively describing the injector fouling behaviour of a blend with respect to the fouling behaviour of the components that comprise it. Simply put, it expresses the fouling behaviour of any blend as a percentage of the difference between the fouling behaviours of the blend components. As such it is expected to enable a quantitative comparison of fouling behaviours determined for different engine types or determined using different test methods.

Algebraically, this can be expressed for a binary system as:

$$\text{Relative fouling behaviour (\%)} = \frac{F_{XY} - F_Y}{|F_X - F_Y|} \times 100,$$

where:

fuel component X exhibits worst-case fouling behaviour $F_X$ (by definition, set at 100%);

fuel component Y exhibits best-case fouling behaviour $F_Y$ (by definition, set at 0%);

and fuel blend XY exhibits fouling behaviour $F_{XY}$.

The relative fouling behaviour of any XY blend is hence expressed as a percentage of $|F_X - F_Y|$.

Assuming that the fouling behaviour of the blends can be interpolated between that of the individual components; the range of expected fouling behaviours is then expressed as a percentage value between 0 and 100%. For example, in an exemplary binary system, where this interpolation is linear, then one would expect to see 50% of the relative fouling behaviour where the blend comprises approximately 50% of each component. Where the relative fouling behaviour and the relative composition are not significantly in agreement, the response of the blend in terms of fouling behaviour is obviously not linear; and a significant synergistic or antagonistic mechanism becomes apparent.

As this quantification is relative to the behaviour of the individual blend components, the absolute values are not critical. Hence any suitable method such as that described in this application or otherwise known in the art is adequate for the purposes of characterising the fouling behaviour of a blend sample. Where required, the fouling behaviour value or indices should initially be expressed relative to, or normalised by, the starting or unfouled scenario.

Injector Fouling Behaviour of GTL-Crude-Derived Diesel Blends in High Pressure Fuel Injection Engines In each of the examples, a significant effect on injector fouling behaviour is observed with adding levels of GTL diesel less than 65 volume %. Critically, this effect manifests as a reduction in relative fouling behaviour of the order of 30 to 70% at fuel blend densities of more than 0.79 g.cm$^{-3}$. Even at fuel blend densities of more than 0.81 g.cm$^{-3}$ (equivalent to a GTL content of ca. 30 volume %) this effect is still significant; with a reduction in relative fouling behaviour of 30% to almost 50%. At fuel blend densities of more than 0.82 g.cm$^{-3}$ (equivalent to a GTL content of ca. 15 volume %) this effect remains significant with a reduction in relative fouling behaviour of almost 30%.

This effect is highly non-linear and appears to indicate a strong synergistic effect of GTL diesel in blends with crude-derived diesel on injector fouling at concentrations in the range 10 to 60 volume %. This effect is of significant commercial value where the fuel blend density exceeds 0.79 g.cm$^{-3}$; more preferably where it exceeds 0.80 g.cm$^{-3}$ and most preferably where it exceeds 0.81 g.cm$^{-3}$. These latter two thresholds are established in commercial diesel fuel specifications in various territories.

Without wishing to be bound by theory, the inventors postulate that this additional highly synergistic effect on injector fouling, specific to high pressure fuel injection engines with small injector hole sizes (less than 200 μm in diameter), results from some property of GTL diesel that is not combustion-related; but instead relates to increased stability under pressure against the formation of deposits as a result of degradation in the fuel delivery system prior to combustion. It is known that pressure can significantly affect chemical kinetics; and it could be reasonably expected that the exposure of fuel to somewhat elevated pressures for extended periods in high pressure directly injected systems would typically result in some related degradation that significantly facilitates deposit formation. When this is coupled with the reduced hole diameters of new technology direct injection injector nozzles, the increased sensitivity of this mechanism exhibited as injector fouling becomes evident. It is very clear from both prior art and experimental data that this sensitivity is not observed for indirectly injected engines, where injector hole sizes are larger; and fuel does not see prolonged elevated pressure prior to combustion.

It is known that GTL diesel exhibits some increased thermal stability when compared to crude-derived diesel. However, this is typically evidenced at temperatures significantly exceeding those seen in high pressure fuel delivery systems prior to combustion. What is of considerable interest here is the apparent role that pressure may be playing in the fouling mechanism; and furthermore the observation that GTL diesel could have such a strong non-linear effect on this mechanism when blended with crude-derived diesel at relatively low levels.

The invention will now be described with reference to the following nonlimiting examples.

EXAMPLE 1

The common rail diesel injector nozzle fouling test described here was carried out on a modern passenger car common rail turbo-diesel engine.

TABLE 1

| Test description of set-up and conditions | |
|---|---|
| Engine type | Four cylinder, 2.2 litre Mercedes Benz engine with a modern high pressure common rail direct injection fuel system |
| Maximum fuel pressure | 1600 bar |
| Injectors | Each injector has seven holes of 136 μm diameter each |

Test Protocol:

The test involves running the engine according to the cycle in FIG. 1 for periods of 8 hours until the measured power drop-off due to injector deposit formation stabilises. For completeness and alignment with other test methods, double tests were performed (i.e. a total of 32 hours of running).

Each test was started with set of brand new injector nozzles and run through a very severe 32 hour test cycle.

Power and fuel flow measurements were taken every half hour at the engine's maximum power operating point.

The results of the test are presented as fuel flow loss over the running time of the test. Any loss in fuel flow measured at the same operating point can be attributed directly to narrowing of the injector holes due to deposits forming during the running time of the test.

Procedure: (Repeated if necessary) 8×60 min test
8 h soak time
8×60 min test

The Bosch test requires accurate measurement of the engine's power output at the 4200 rpm, full load points. If significant injector deposits form, the fuel flow through the injector will be restricted and a subsequent power loss will be measured.

The power data is the primary outcome of the Bosch test and provided no other engine components have deteriorated; it can be attributed directly to injector deposits.

A facility to accurately measure fuel consumption can also be used to present the results in terms of a reduction in fuel flow.

Fuel flow was measured in kg/h by an AVL 735 coriolis mass flow meter. These results were then converted to volume flow rate values to account for the different fuel blend densities. The data is then typically plotted to represent the change in fuel flow over the test running time, and is normalised relative to the initial fuel flow value obtained at the start of the test (prior to the occurrence of any fouling).

The relative performance of the sample fuels or blends described in Table 2 was then evaluated.

TABLE 2

Details of test fuels and additives used in this study

| Fuel | Fuel description |
|---|---|
| EN590 | Crude-derived sample<br>EN590 European standard reference |
| GTL | Highly paraffinic sample<br>Neat GTL diesel with 200 ppm commercial ester-based Lubricity Improvement Additive (LIA) |
| GTL A | Neat GTL diesel with 200 ppm commerical acid-based LIA |
| 80/20 | Blend: 80% EN590 with 20% (v/v) GTL diesel |
| 80/20 D | Blend: 80% EN590 with 20% (v/v) GTL diesel with detergency additive |
| HAZ 1 | Nerefco EN590 with 1 ppm zinc neodecanoate; used to indicate the sensitivity of the test method. Zinc is known to accelerate the formation of injector deposits and can hence be used to indicate "worst case" deposit formation |

Figure 2:
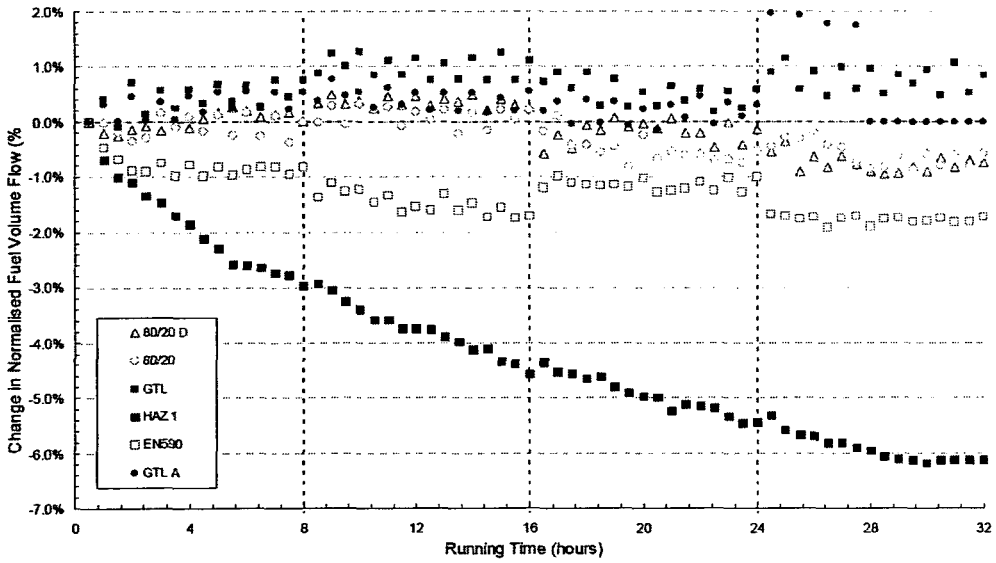
FIG. 2 is a graph depicting change in normalized fuel volume flow (%) versus running time (hours) for different test fuels.
Figure 3:
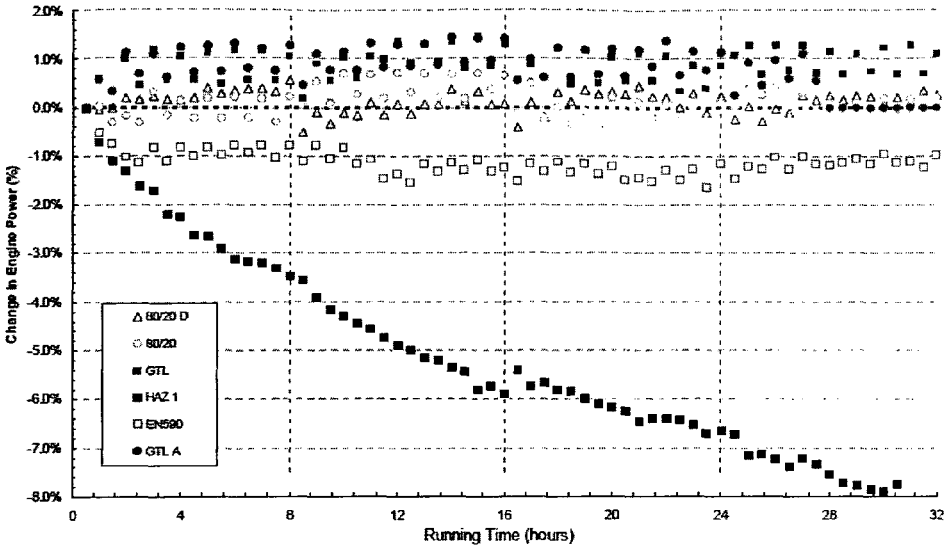
FIG. 3 is a graph depicting change in engine power (%) versus running time (hours) for different test fuels.

The results presented graphically in FIG. 2 represent the percentage change in the volume fuel flow over the running time of the test relative to the first recorded data point. The broken red lines after eight hour intervals represent eight hour soaking periods where it is expected that any labile deposits would break off and be removed upon restart. The results presented as a change in engine power are summarised in FIG. 3 and show good correlation with the fuel flow measurements. The change is relative to the first measured data point and all data is collected at 30 minute intervals as per FIG. 1. (4200 rpm, 100% load).

It is evident from the data shown here that, whilst pure GTL diesel exhibits little reduction in fuel flow during the course of the test, crude-derived diesel (EN590) exhibits approximately 2% reduction in normalised fuel volume flow. This can be directly attributed to injector nozzle fouling in the case of the crude-derived fuel sample. (The slight increase in fuel flow in the case of the GTL-derived diesel samples can be ascribed to the phenomenon of injector running-in.)

More importantly, with reference to this invention, the crude/GTL blend samples (indicated as 80/20 and 80/20D) exhibit a reduction in normalised fuel flow of less than 1%. If this end-value (at the completion of the test) is expressed in terms of the relative fouling behaviour descriptor previously defined, then the crude/FT blend has a value of approximately 55%. Given that this is achieved at a blend ratio of 80/20 (crude/GTL v/v), the effect of introducing GTL diesel on injector fouling behaviour is therefore observed to be highly non-linear and extremely positive at relatively low concentrations of GTL diesel.

In Table 3, the densities and the calculated relative fouling behaviours for the samples studied are indicated.

TABLE 3

Relative fouling behaviour of key samples

| Sample | Flow rate | % GTL | Relative fouling behaviour (%) | Sample density ($g \cdot cm^{-3}$) |
|---|---|---|---|---|
| EN590 | −1.84 | 0 | 100 | 0.8283 |
| 80/20 EN590/GTL (v/v) | −0.78 | 20 | 57.94 | 0.8163 |
| 80/20 EN590/GTL D (v/v) | −0.78 | 20 | 51.19 | 0.8163 |
| GTL | 0.68 | 100 | 0 | 0.7691 |

Figure 4:
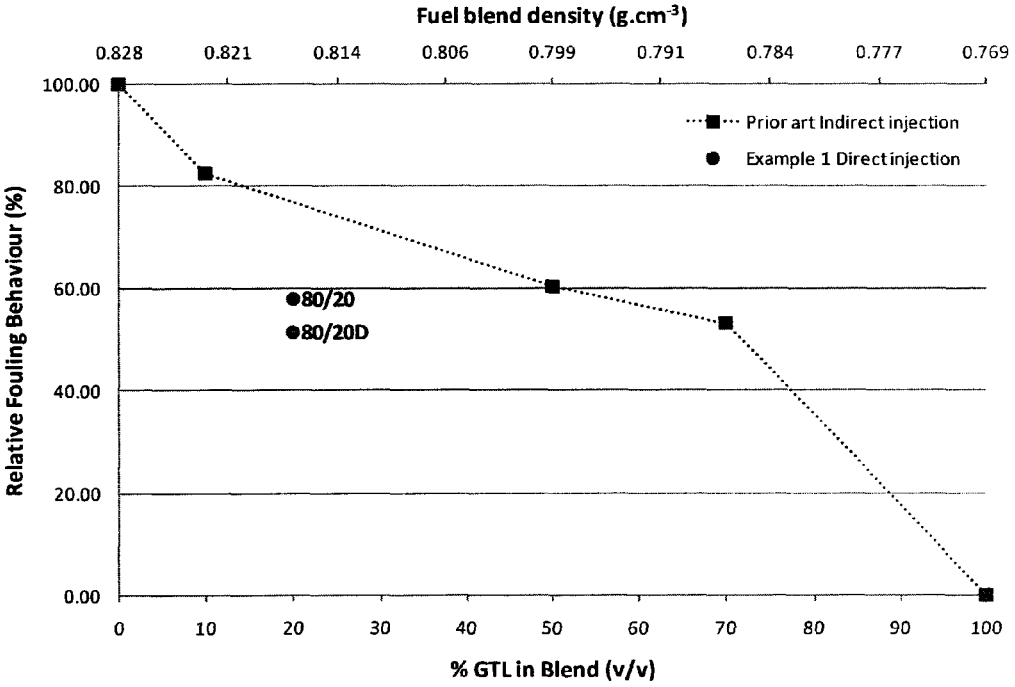
FIG. 4 is a graph depicting relative fouling behavior (%) versus % GTL in blend (v/v) and fuel blend density (g.cm$^{-3}$) in the blend of Example 1, wherein prior art fouling behavior values for an indirectly injected engine test are plotted alongside the results from Example 1.

For comparison, prior art fouling behaviour values for an indirectly injected engine test (carried out on a series of crude-GTL blends have been plotted alongside the results from Example 1, as a function of blend composition in FIG. 4. The relative fouling behaviour of the crude-GTL blends of the directly injected engine is significantly reduced at far lower GTL component addition levels than was observed in the prior art indirectly injected engine test.

Core to this invention therefore is the unexpected observation that, in the case of a high pressure direct injection diesel engine, a significantly reduced amount of GTL-derived diesel was required to significantly improve the fouling behaviour of the blend relative to the crude-derived component, from that previously known in similar fuel blends in indirectly injected diesel engines. Most usefully, this blend observation allows the significant improvement of the relative injector fouling behaviour of blends without requiring significant additions of GTL diesel. This allows achieving a much lower fouling fuel blend with commercially viable densities.

EXAMPLE 2

Figure 5:
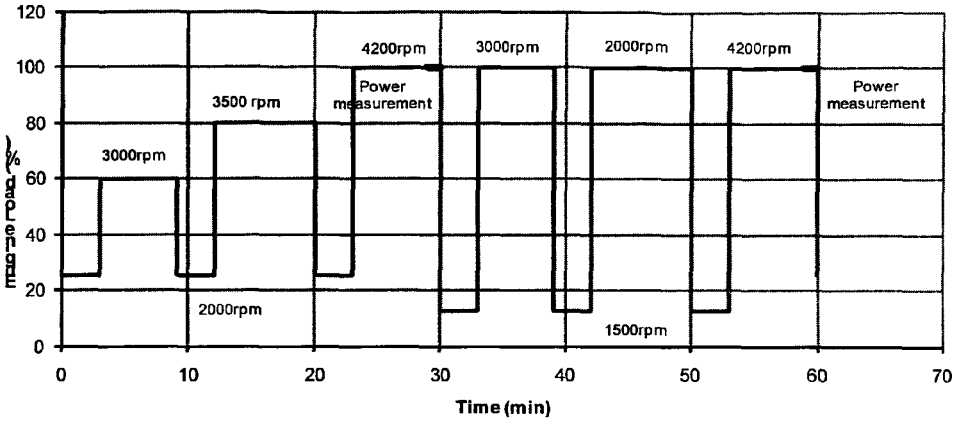
FIG. 5 is a graph depicting load (%) versus running time (hours) for a modified common rail diesel injector nozzle fouling test cycle from Example 2.

The common rail diesel injector nozzle fouling test carried out in Example 1 was repeated using a slightly modified test cycle as illustrated in FIG. 5. (The cycle was slightly amended to enable a more consistent measurement of the two measuring points.)

Figure 6:
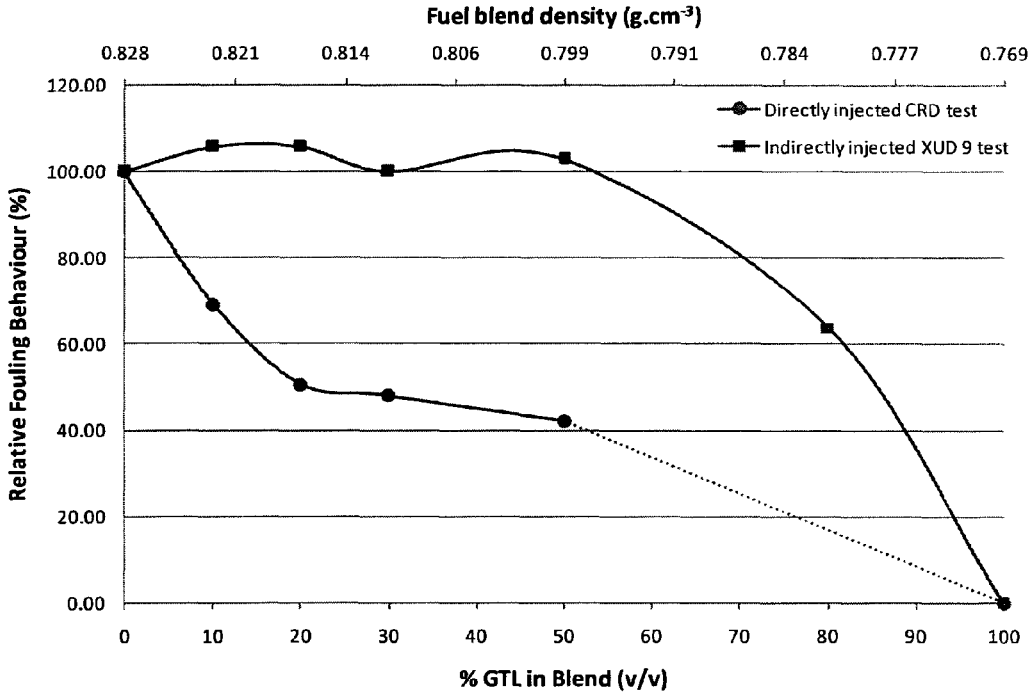
FIG. 6 is a graph depicting relative fouling behavior (%) versus % GTL in blend (v/v) and fuel blend density (g.cm$^{-3}$) for a range of blends of EN590 diesel (crude-derived) and GTL diesel as in Example 2.

The relative fouling behaviour of a range of blends of EN590 diesel (crude-derived) and GTL diesel was investigated for the CRD engine. For comparison a set of tests was carried out on the same set of blends using an indirectly injected engine industry standard CEC F-23-01 Peugeot XUD-9 test. The results for these two sets of test are compared in Table 4 below and illustrated graphically in FIG. 6.

TABLE 4

Comparison of test results for GTL/crude diesel blends

HIGH PRESSURE DIRECT INJECTION ENGINE TEST: Modified CEC F-98-08 DW10 test

| Sample | % GTL | % Fuel flow change | Relative fouling behaviour (%) | Sample density ($g \cdot cm^{-3}$) |
|---|---|---|---|---|
| EN590 | 0 | −1.2 | 100 | 0.8283 |
| G10E90 | 10 | −0.83 | 69.06 | 0.8223 |
| G20E80 | 20 | −0.61 | 50.66 | 0.8163 |
| G30E70 | 30 | −0.58 | 48.03 | 0.8106 |
| G50E50 | 50 | −0.50 | 42.04 | 0.7987 |
| G80E20 | 80 | NA | NA | 0.7809 |
| GTL | 100 | 0 | 0 | 0.7691 |

INDIRECTLY INJECTION ENGINE TEST: CEC F-23-01 Peugeot XUD-9

| Sample | % GTL | XUD-9 Test result | Relative fouling behaviour (%) | Sample density (g · cm-3) |
|---|---|---|---|---|
| EN590 | 0 | 80 | 100.00 | 0.8283 |
| G10E90 | 10 | 82 | 105.56 | 0.8223 |
| G20E80 | 20 | 82 | 105.56 | 0.8163 |
| G30E70 | 30 | 80 | 100 | 0.8106 |
| G50E50 | 50 | 81 | 102.78 | 0.7987 |
| G80E20 | 80 | 67 | 63.89 | 0.7809 |
| GTL | 100 | 44 | 0 | 0.7691 |

The strong response of the relative fouling behaviour of the blend to levels of GTL less than 50%, (commensurate with fuel blend densities greater than 0.79 $g.cm^{-3}$) for the directly injected engine case is very evident when compared with the indirectly injected engine case.

The invention claimed is:

1. A system comprising:

a diesel engine comprising a high pressure fuel injection system, the high pressure fuel injection system comprising an injector nozzle, wherein the high pressure fuel injection system is configured to operate at a fuel pressure at the injector nozzle in excess of 1000 bar and at a fuel temperature at a tip of the injector nozzle of 250 -350° C.; and a highly paraffinic distillate fuel composition configured for reducing formation of injector nozzle deposits in the high pressure fuel injection system when combusted in the diesel engine, wherein the highly paraffinic distillate fuel comprises a blend of individual components, wherein the hi hl paraffinic distillate fuel has a relative fouling behaviour of 70% or less, expressed as a percentage of a difference between fouling behaviors of the individual components and a fouling behavior of the highly paraffinic distillate fuel, and wherein the highly paraffinic distillate fuel has an aromatics content less than 0.1 wt %, a sulphur content less than 10 ppm and a paraffinic content of at least 70 wt %, and a density of more than 0.815 g. $cm^{-3}$ (at 15° C.).

2. The system of claim 1, wherein the diesel fuel composition has a relative fouling behaviour of 60% or less.

3. The system of claim 1, wherein the relative fouling behaviour 50% or less and a density of more than 0.79 g. $cm^{-3}$ (at 15° C.).

4. The system of claim 1, wherein the highly paraffinic distillate fuel is derived from a Fischer Tropsch process, a hydrogenated renewable oil, or a combination thereof.

5. The system of claim 1, wherein the highly paraffinic distillate fuel has a cetane number greater than 70.

6. The system of claim 1, wherein the highly paraffinic distillate fuel has a minimum relative fouling behaviour of 30%.

7. The fuel system of claim 1, wherein the diesel engine is a common rail diesel engine.

8. The system of claim 1, wherein the high pressure fuel injection system has one or more injector nozzles each having one or more holes of a maximum equivalent diameter of 200 μm.

9. The system of claim 8, wherein each of the holes has a maximum equivalent diameter of 150 μm.

10. A method of operating a diesel engine with reduced injector nozzle deposits, comprising:

providing the system of claim 1; and combusting the highly paraffinic distillate fuel in the diesel engine having a high pressure fuel injection system, wherein the highly paraffinic distillate fuel exhibits, in the diesel engine, a relative fouling behaviour of 70% or less.

11. The method of claim 10, wherein the highly paraffinic distillate fuel exhibits, in the diesel engine, a relative fouling behaviour of 60% or less.

12. The method of claim 10, wherein the highly paraffinic distillate fuel exhibits, in the diesel engine, a relative fouling behaviour of 50% or less, and wherein the highly paraffinic distillate fuel has a density of more than 0.79 g. $cm^{-3}$ (at 15° C.).

13. The method of claim 10, wherein the highly paraffinic distillate fuel is derived from a Fischer Tropsch process, a hydrogenated renewable oil, or a combination thereof.

14. The method of claim 10, wherein the highly paraffinic distillate fuel has a cetane number greater than 70.

15. The method of claim 10, wherein the highly paraffinic distillate fuel exhibits, in the diesel engine, a minimum relative fouling behaviour of 30%.

16. The method of claim 10, wherein the diesel engine is a common rail diesel engine.

17. The method of claim 10, wherein the high pressure fuel injection system has one or more injector nozzles each having one or more holes of a maximum equivalent diameter of 200 μm.

18. The method of claim 17, wherein each of the holes has a maximum equivalent diameter of 150 μm.

19. The method of claim 10, further comprising:

storing the highly paraffinic distillate fuel in a central accumulator rail, whereby the fuel is heated, thereafter;

delivering a portion of the heated fuel to the injector nozzle for combusting in the diesel engine;

returning unused heated fuel to a fuel tank; and reintroducing returned unused heated fuel back into the central accumulator rail on demand.

20. The method of claim 19, wherein the unused heated fuel has a temperature in excess of 100° C.

21. The system of claim 1, wherein the highly paraffinic distillate fuel comprises a fuel blend XY of a fuel component X and a fuel component Y, wherein the relative fouling behaviour, as a percentage, is defined by a formula:

$$\frac{F_{XY} - F_Y}{|F_X - F_Y|} \times 100$$

wherein:

the fuel component X exhibits a worst-case fouling behaviour $F_x$ set at 100%;

the fuel component Y exhibits a best-case fouling behaviour $F_y$ set at 0%; and the fuel blend XY of the fuel component X and the fuel component Y exhibits a fouling behaviour $F_{XY}$.

22. The system of claim 1, wherein the diesel engine is configured to store the highly paraffinic distillate fuel in a central accumulator rail prior to fuel being delivered to the injector nozzle, wherein the diesel engine is configured to return an unused heated fuel from the central accumulator rail back to a fuel tank; and wherein the diesel engine is configured to introduce returned unused heated fuel back into the central accumulator rail on demand.

23. The system of claim 22, wherein the unused heated fuel has a temperature in excess of 100° C.

* * * * *

UNITED STATES PATENT AND TRADEMARK OFFICE

CERTIFICATE OF CORRECTION

PATENT NO. : 9,080,118 B2
APPLICATION NO. : 13/696026
DATED : July 14, 2015
INVENTOR(S) : Schaberg et al.

It is certified that error appears in the above-identified patent and that said Letters Patent is hereby corrected as shown below:

In the Drawings

Sheet 1 of 3 (y-axis, Figure 2) at line 1, Change "(%" to --(%)--.

In the Specification

In column 4 at line 58, Change "10 ppm" to --10 ppm.--.

In column 5 at line 30 (approx.), Change "i. e." to --i.e.--.

In column 6 at line 38, Change "fouling" to --fouling.--.

In column 9 at line 41, Change "commerical" to --commercial--.

In the Claims

In column 11 at line 49, In Claim 1, change "hi hl" to --highly--.

In column 11 at line 61, In Claim 3, after "behaviour" insert --of--.

In column 12 at line 4, In Claim 7, after "The" delete "fuel".

In column 12 at line 67, In Claim 21, change "$F_x$" to --$F_X$--.

In column 13 at line 2, In Claim 21, change "$F_y$" to --$F_Y$--.

Signed and Sealed this
Eighth Day of March, 2016

Michelle K. Lee

Michelle K. Lee
*Director of the United States Patent and Trademark Office*